US005765425A

United States Patent [19]

Pipan

[11] Patent Number: 5,765,425

[45] Date of Patent: Jun. 16, 1998

[54] RADIAL EXTRUSION PROCESS COMBINED WITH INSIDE TUNE IRONING

[76] Inventor: Janez Pipan, Mala vas 10/a, 6000 Ljubljana, Slovenia

[21] Appl. No.: 937,265

[22] Filed: Sep. 15, 1997

Related U.S. Application Data

[63] Continuation of Ser. No. 553,604, filed as PCT/SI94/00007 May 16, 1994, abandoned.

[30] Foreign Application Priority Data

May 17, 1993 [SI] Slovenia ..... P-9300258

[51] Int. Cl.[6] ..... B22B 21/00; B21C 23/04

[52] U.S. Cl. ..... 72/264; 72/353.2; 72/355.4

[58] Field of Search ..... 72/264, 265, 355.4, 72/355.2, 353.2, 356, 358, 370, 393

[56] References Cited

U.S. PATENT DOCUMENTS

| | | | |
|---|---|---|---|
| 3,899,912 | 8/1975 | Orain | 72/355.4 |
| 4,611,391 | 9/1986 | Franz et al. | 72/355.4 |

FOREIGN PATENT DOCUMENTS

| | | | |
|---|---|---|---|
| 3-210933 | 9/1991 | Japan | 72/355.4 |
| 145207 | 1/1962 | U.S.S.R. | 72/370 |

*Primary Examiner*—Lowell A. Larson
*Assistant Examiner*—Rodney Butler
*Attorney, Agent, or Firm*—Abelman, Frayne & Schwab

[57] ABSTRACT

A subject of the invention is the radial extrusion process combined with inside tube ironing, which is in essence a cold extrusion process and can be reckoned among bulk metal forming processes. It enables tube shaped metal semiproducts to be formed into different final shaped parts or parts that are intended for additional working, for example by machining. The process is grounded on insertion of a tube, which may be on one end previously expanded, into a proper shaped die, where on one side there is a punch which is retained with a determined force and inside which lies a free movable mandrel, while from the other side in working stroke the counter-punch extrude the difference of tube volume which results from ironing of the tube, in the direction of counter-punch travel so, that the material fills up the starting clearance between the mandrel and the tube, the space between the tube and the punch and arbitrary shaped space in the punch or in the die.

3 Claims, 1 Drawing Sheet

RADIAL EXTRUSION PROCESS COMBINED WITH INSIDE TUNE IRONING

Figure 1:
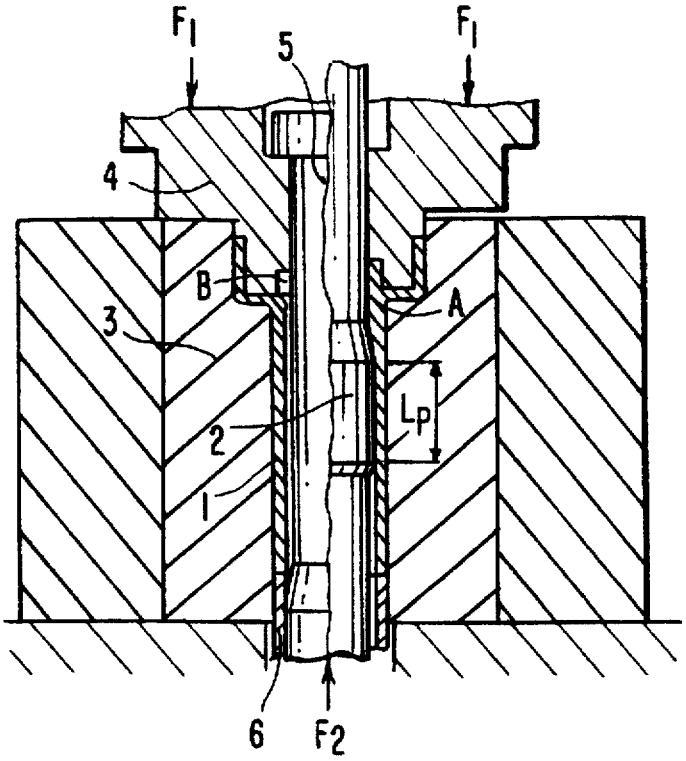

This application is a continuation application under 37 C.F.R. 1.62 of prior application Ser. No. 08/553,604, filed Nov. 16, 1995, abandoned.

A subject of the invention is the radial extrusion process combined with inside tube ironing, that is a cold extrusion process, which is reckoned among bulk metal forming processes. It enables tube shaped metal semiproducts to be formed into different final parts or parts that are intended for additional working by machining.

The invention is classified into the class B 21D 22/00 of the international patent classification.

The technical problem which the submitted invention is sucessfully solving is a determination and accomplishment of such a process which will enable different axisymmetric tube-shaped parts which are generally characterised by longer cylindrical stem on one side and non-uniform diameter with severe thickening of the wall together with complicated cross-section shapes on another side, to be formed from a simple tube billet, cut from a standard thin-walled or medium-walled tube billet which is preformed in such a way that a larger diameter at one end results.

Characteristic shapes of parts, that can be performed by the process after the invention are shown in FIG. 2, where the shapes on the left from the symmetry axes present the shapes at the beginning of the process and the shapes of the right the states after forming.

The manufacturing of longish, thin-walled, axial symmetric parts by cold-forming of tube-shaped billets is most preferable when high strength parts are concerned. The strength is increased due to fibrous grain structure and deformation hardening arising during cold forming. On the other hand due to similarity of the shapes at the begining and at the end of the process, the forming can be completed in a single step with moderate average plastic deformation so a sufficient toughness of the material is still left.

In most forming processes that are used in manufacturing of tube-shaped parts, the tube wall thickness change is not intentional, but results from the changes of other two dimensions, the diameter and the length. Such processes are bending, sinking, expanding, bulging by means of pressure medium, spinning, etc.

The intentional changes of wall-thickness occures by the processes like forward extrusion, radial extrusion, ironing, flow turning, rotational forging and rotary upsetting of tube ends. A special problem arises whenever a local rotational-symmetric thickening of the wall or a severe cross-section shape change is demanded.

Local rotational-symmetric wall thickening can be performed only by tube upsetting in the axial direction, which in case of laterally unsupported tube wall, causes wrinkling. The most frequent method for preventing the occurance of wrinkles is supporting the tube wall by the supporting mandrel from the inside and by the die from the outside. As the total surface on which the sliding friction occures is large comparing with the deforming volume, the friction has an important role on the forming process. The thinner the wall and the longer lateraly supported part of the tube over which the forming force transmits, more pronounced is the influence of the friction. The problem of friction is especially important in case of the radial extrusion process where the compressive stresses, which are required to make the material fill up the die properly may be several times higher than the material flow stress. The known radial extrusion process in which the forming force acts on the tube ends is therefore useful only in case of relatively short tubes or tubes with thicker walls.

The radial extrusion process combined with inside tube ironing after invention is based on forming a tube - shaped workpiece, which may be previously expanded at one end in such a manner, that it is inserted into a properly shaped die. From one side of the die there is a properly shaped punch inside which there is a free axially movable mandrel. While the punch stays retained by a determined force, from the opposite side a counter-punch, the diameter of which is some larger than the tube inner diameter, preforms a working stroke during which the tube wall thickness is reduced. The same time the difference of the material volume is pushed forward, first filling up the clearance between the mandrel and the tube and after that the space between the punch and the die.

The detailed description of the process after the invention is based on the performed example and FIG. 1 and FIG. 2 which show:

FIG. 1 shematic of the beginning and the end state of radial extrusion process combined with inside tube ironing, performed for forming a hollow rotation - symmetric thin - walled part with non-uniform diameter together with complex cross-section shape FIG. 2 typical shapes of parts that can be formed using the radial extrusion process combined with inside tube ironing after the invention FIG. 1 shows the radial extrusion process combined with inside tube ironing, used in a concretly performed example at the beginning and at the end. This process can be carried out on vertical or horizontal hydraulic or mechanical presses with at least two, but preferable three independent actions.

The tube 1, the upper end of which may be previously expanded, is inserted into the die 3, which is fastened to the press table. Thereafter the punch 4 is pushed down so that it contacts the die face and stays retained with a determined force $F_1$, which provides maintaining of the hydrostatic pressure needed in the deformation zone A where the radial extrusion process takes place. Inside the punch 4 there is a free movable mandrel 5, the diameter of which is for easier entering into the tube smaller than the inner diameter of the tube 1. Instead of the free movable mandrel also a counter-punch with a corresponding prolongation on the upper side the diameter of which corresponds to that of the mandrel 5, could not be used. The working stroke is performed by the counter-punch 2 which is widened along the distance $L_p$ so that its diameter is larger than the initial inside diameter of the tube. During the working-stroke, the difference of the volume resulting from the tube wall thinning is pushed forward towards the punch 4, first filling the initial clearance between the tube 1 and the mandrel 5 and thereafeter, with the hydrostatic pressure being considerable increased, also the space B between the punch 4 and the mandrel 5. A further extrusion of the material towards the zone A, caused by an additional upward movement of the counter-punch 2, causes an additional increase of the hydrostatic pressure in the zone A, up to the value which depends on force $F_1$ by which the punch 4 is retained. In this case the punch 4 is pushed upwards for the distance which depends on the additional volume of the material extruded by the punch 2. For filling a cavity like that of zone B, the assistence of friction between the tube 1 and the upward moving mandrel 5 is beneficial, so a good accuracy of such a detail can be achieved with a lower hydrostatic pressure in the zone A. Depending on the demanded shape of the part, an empty space B can also be formed in the die 3. The accurate shape of the final part, which is determined by the shape of the die 3, the punch 4, the counter-punch 2, the mandrel 5 and the travel of the counter punch 2, can be achieved only if the hydrostatic pressure in the deforming zone A, which is limited by the retaining force $F_1$, is high enough. Because of the high hydrostatic pressure in the zone A a backward flow of the material (regarding the moving direction of the counter-punch 2) can occure. This can be prevented by a proper dimensions of the widened portion of the counter-punch 2, where the length $L_p$ is essential for the effect of friction acting in the direction of the counter-punch movement. In addition to friction effect, the undesirable backward flow of material is prevented by the fixed support 6, to which only a force, which do not cause an axial upsetting of the tube 1 below the widened portion of the counter-punch 2, may be transmitted.

A special advantage of the process after invention is that the friction effect, that contributes to the forming force $F_2$ can be controlled even when a longer cylindrical portions of the tube, along which the ironing takes place, are concerned. Taking into consideration the empty volume between the tube and the mandrel and the volume extruded by the counter-punch during ironing, first depending on the diameter of the mandrel and the second depending on the diameter of ironing (the diameter of the widended portion of the counter-punch 2), the both diameters can be chosen so, that the phase during which the filling of the clearance between the tube 1 and the mandrel 5 takes place, ends late enough, so that the high hydrostatic pressure in the zone A, that arises after the end of this phase and resulting friction that affects the forming force $F_2$, is present only near the end of the forming stroke.

Figure 2A:
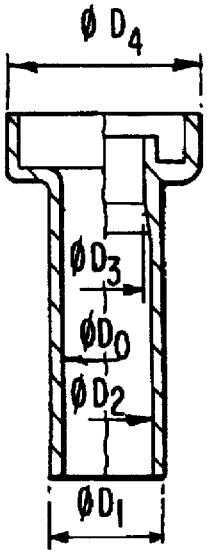
Figure 2B:
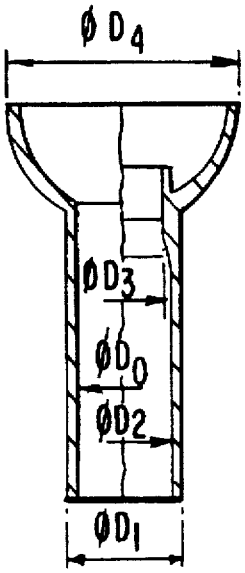
Figure 2C:
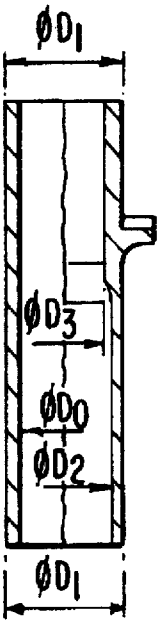

In FIG. 2 three typical shapes of parts which can be formed using the radial extrusion process combined with inside tube ironing after the invention are shown. The cross-sections on the left sides from the symmetry axes presents the workpieces before and on the right after forming. In case of parts shown in FIG. 2*a* and 2*b*, which can present parts of high-pressure valves, preforming of tubes by sinking or expanding from original outer diameter to diameters $D_4$ and $D_1$ is foreseen. The part shown in FIG. 2*c*, which can present a part of clutch, can be formed from a simple tube with the outer diameter $D_1$ and inner diameter $D_0$. Characteristically for the radial extrusion process combined with inside tube ironing after the invention is, that the length of the workpiece during the process remains approximately the same, while the inside diameter of the tube $D_0$ is changed to the diameter $D_2$ along the ironing stroke and reduced to the diameter of the mandrel $D_3$, from the end of ironing zone up to the face of the punch 4.

I claim:

1. A radial extrusion process combined with inside tube ironing, by which a tube (1) with thin walls relative to an axial length of said tube (1), an upper portion of which tube (1) was previously expanded in diameter relative to a remainder of said tube (1) with a smaller diameter, is ironed from the inside along said remainder and radially extruded in a region between said smaller and said expanded tube diameter, said process comprising the steps of:

said tube (1) being inserted into an appropriately shaped die (3);

a punch (4) being moved in a first direction and retained with a determined force on said upper portion of said tube (1), said punch (4) having inside it a free movable mandrel (5); and a counter-punch (2), said counter-punch (2) having a diameter at a top which is the same as the diameter of the mandrel (5) and which is conically enlarged so that, along a determined length (Lp) from said top, said diameter of said counter-punch (2) is larger than an initial inside diameter within said remainder of said tube (1), said counter-punch (2) being moved in a second direction within said remainder of said tube (1) opposite to said first direction and extruding a difference of said tube (1) volume that results from ironing said tube (1) in said second direction, thereby causing material comprising said difference of said tube (1) volume to fill an initial clearance between said mandrel (5) and said tube (1), a first space between said tube (1) and said punch (4), and a second space between said punch (4) and said mandrel (5), said counter-punch (2) being in contact with a portion of said material comprising said difference of said tube volume (1) while extruding said difference of said tube (1) volume.

2. A radial extrusion process combined with inside tube ironing, by which a tube (1) with thin walls relative to an axial length of said tube (1) is ironed from the inside along a lower portion of said tube (1) and radially extruded in a region between an upper portion and said lower portion of said tube (1), said process comprising the steps of:

said tube (1) being inserted into an appropriately shaped die (3);

a punch (4) being moved in a first direction and retained with a determined force on said upper portion of said tube (1), said punch (4) having inside it a free movable mandrel (5); and a counter-punch (2), said counter-punch (2) having a diameter at a top which is the same as the diameter of the mandrel (5) and which is conically enlarged so that, along a determined length (Lp) from said top, said diameter of said counter-punch (2) is larger than an initial inside diameter within said tube (1), said counter-punch (2) being moved in a second direction within said lower portion of said tube (1) opposite to said first direction and extruding a difference of said tube (1) volume that results from ironing said tube (1) in said second direction, thereby causing material comprising said difference of said tube (1) volume to fill an initial clearance between said mandrel (5) and said tube (1), said counter-punch (2) being in contact with a portion of said material comprising said difference of said tube volume (1) while extruding said difference of said tube (1) volume.

3. A radial extrusion process combined with inside tube ironing, by which a tube (1) with thin walls relative to an axial length of said tube (1), an upper portion of which tube (1) was previously expanded in diameter relative to a remainder of said tube (1) with a smaller diameter, is ironed from the inside along said remainder and radially extruded in a region between said smaller and said expanded tube diameter, said process comprising the steps of:

said tube (1) being inserted into an appropriately shaped die (3);

a punch (4) being moved in a first direction and retained with a determined force on said upper portion of said tube (1); and a counter-punch (2), which is conically enlarged so that, along a determined length (Lp) from a top of said counter-punch (2), said diameter of said counter-punch (2) is larger than an initial inside diameter within said remainder of said tube (1), said counter-punch (2) having formed on said top thereof a prolongation with a diameter which corresponds to the diameter of the mandrel in claim 1, said counter-punch (2) being moved in a second direction within said remainder of said tube (1) opposite to said first direction and extruding a difference of said tube (1) volume that results from ironing said tube (1) in said second direction, thereby causing material comprising said difference of said tube (1) volume to fill an initial clearance between said prolongation and said tube (1), a first space between said tube (1) and said punch (4), and a second space between said punch (4) and said prolongation, said counter-punch (2) being in contact with a portion of said material comprising said difference of said tube volume (1) while extruding said difference of said tube (1) volume.

* * * * *

UNITED STATES PATENT AND TRADEMARK OFFICE

CERTIFICATE OF CORRECTION

PATENT NO. : 5,765,425

DATED : June 16, 1998

INVENTOR(S) : PIPAN

It is certified that error appears in the above-identified patent and that said Letters Patent is hereby corrected as shown below:

On the Cover Page of the Patent, in Column 1, after "[54] the Title of the Invention should be changed from "Radial Extrusion Process Combined With Inside Tune Ironing" to -- Radial Extrusion Process Combined With Inside Tube Ironing --.

At Column 1, line 1 of Patent, please change the penultimate word of the Title of the Invention from "tune" to -- tube --.

IN THE SPECIFICATION

Page 3, line 15: after "longer", please insert --the--, and please delete "lateraly", and substitute therefor --laterally--.

Page 3, line 16: please insert --the-- before "more".

Page 3, line 23: please insert --the-- after "after".

Page 3, line 24: please delete "my", and substitute in lieu thereof --may--.

Page 4, line 5: please delete "some", and substitute therefor --somewhat--.

Page 4, line 12: please delete "shematic", and substitute therefor --schematic--.

Page 4, line 18: please delete "tipical", and substitute therefor --typical--.

Page 5, line 11: please delete "could not", and substitute --can--.

UNITED STATES PATENT AND TRADEMARK OFFICE

CERTIFICATE OF CORRECTION

PATENT NO. : 5,765,425
DATED : June 16, 1998
INVENTOR(S) : PIPAN

It is certified that error appears in the above-identified patent and that said Letters Patent is hereby corrected as shown below:

Page 5, line 17: please delete "thereafeter", and substitute therefor -- thereafter --.

Page 5, line 19: please delete "coused", and substitute therefor -- caused --.

Page 6, line 17: please delete "taht" and substitute therefor -- that --.

Signed and Sealed this

First Day of May, 2001

*Attest:*

Nicholas P. Godici

NICHOLAS P. GODICI

*Attesting Officer*

*Acting Director of the United States Patent and Trademark Office*